US006568239B1

(12) United States Patent
Champaigne

(10) Patent No.: US 6,568,239 B1
(45) Date of Patent: May 27, 2003

(54) TEST STRIP AND METHOD FOR CONFIRMING SHOT PEENING COVERAGE

(76) Inventor: Jack Champaigne, 1428 W. 6th St., Mishawaka, IN (US) 46544

( * ) Notice: Subject to any disclaimer, the term of this patent is extended or adjusted under 35 U.S.C. 154(b) by 0 days.

(21) Appl. No.: 09/898,966

(22) Filed: Jul. 3, 2001

(51) Int. Cl.[7] ..... G01N 37/00
(52) U.S. Cl. ..... 73/1.04; 73/1.01; 73/866
(58) Field of Search ..... 73/1.01, 1.04, 73/866, 104, 105

(56) References Cited

U.S. PATENT DOCUMENTS 3,950,642 A * 4/1976 Feld ..... 250/302
5,731,509 A * 3/1998 Thompson ..... 73/11.02

* cited by examiner

*Primary Examiner*—Helen Kwok
*Assistant Examiner*—Rodney Frank
(74) *Attorney, Agent, or Firm*—James D. Hall; Ken C. Decker

(57) ABSTRACT

Shot peening coverage is confirmed by mounting a test strip having surface irregularities of graduated depth on a surface of a component undergoing peening for which peening coverage is to be confirmed. The component, with the test strip attached thereto, is exposed to the shot stream under production conditions. The strip, which is selected according to a procedure described herein such that some, but not all, of the surface irregularities are removed when proper peening coverage is attained, is then removed and examined.

11 Claims, 3 Drawing Sheets

TEST STRIP AND METHOD FOR CONFIRMING SHOT PEENING COVERAGE

TECHNICAL FIELD

This invention relates to method and apparatus for confirming shot peening coverage.

BACKGROUND OF THE INVENTION

Shot peening has been common practice in the treatment of metal components to increase surface hardness and fatigue life. In shot peening, spherical shot is impacted on the surface of a component, thereby forming very small spherical dents on the surface. However, the process must be carefully controlled, because shot peening above and below a critical intensity results in a component having less than optimal properties.

Two critical shot peening perimeters are intensity and coverage. Peening intensity is a function of the kinetic energy of the shot impacted upon the surface of the component, which is a function of shot velocity and shot size. Commonly, shot is accelerated by using air pressure to force the shot through a peening nozzle which is directed at the surface undergoing peening. In order to confirm shot peening intensity, the almen strip process has been used for many years. Thin metal strips which deflect when undergoing peening are mounted in a special holder in which a critical section of the strip is unsupported. The strip thus installed on the holder is exposed to the shot stream under (as closely as possible) the same conditions as the component undergoing peening. After the strip has undergone peening for a predetermined time period, the strip is removed from the holder and the deflection measured, all according to known procedures. Accordingly, a series of almen strips are exposed to the shot stream for increasing time periods. When the deflection of the strips increases by no more than ten percent (10%) when the time is doubled, the intensity is said to be at saturation, and peening of the component parts may begin at this saturation intensity.

Peening coverage of a component is a factor of intensity, but may be affected by other factors. For example, since the goal of peening is to cover the surface being peened by small dents or dimples formed by the impact of the shot, the hardness of the component will affect the size of the dimples and hence coverage is also a factor of hardness. The peening nozzle which directs shot to the component is usually automatically moved at a predetermined stroke rate. If the nozzle becomes out of adjustment, or the stroke rate is somehow changed either through a machine malfunction or otherwise, coverage may also be affected, even though the common almen strip procedure indicates no change in intensity. Therefore, coverage can only be confirmed by an extremely laborious and highly skilled method of physically observing the surface of the article being peened, usually with the aid of a microscope, in order to confirm that the entire surface has been covered with the aforementioned dimples or dents. In mass production, the intensity of the peening equipment is periodically checked by the almen strip method, but no convenient method of determining coverage, other than the aforementioned manual examination, has been available.

One prior art method of establishing peening coverage is disclosed in US. Pat. No. 3,950,642, which discloses a test strip coated with a fluorescent dye which is peened and then compared to a control strip to determine coverage, since a greater percentage of the fluorescent dye will be removed from the strip as coverage increases. Another prior art method in common use is to mount a test strip on a component undergoing peening and then microscopically examine the test strip to establish coverage, by examining for dimples or dents or changes in physical characteristics of the strip.

SUMMARY OF THE INVENTION

According to one embodiment of the invention, a test strip having surface irregularities distributed over the surface of the strip is mounted on the surface of a component undergoing peening, which is then peened. The test strip is then removed and the surface compared with a standard to determine coverage. This may be done by physically comparing the test strip with an archived standard test strip, comparing the test strip with a paper copy of the test surface of a test strip, or (if the examiner has had sufficient experience) by an examiner viewing the test strip and making a judgment as to whether coverage is sufficient.

According to another embodiment of the invention, a test strip having multiple regions of surface irregularities of graduated depth is mounted on a surface of the component undergoing peening for which peening coverage is to be confirmed. The component, with the test strip attached thereto, then is exposed to the shot stream under production conditions. The strip is then removed and examined. Since the surface irregularities are of graduating depth, and since the strip has been selected according to a procedure hereinafter described, when the test strip has been exposed to shot at the desired coverage level, some of the irregularities will be obliterated while the deeper irregularities will remain. The test strip may also be compared with an archived standard test strip or a copy of an archived standard test strip.

Accordingly, coverage of shot peening is confirmed without the laborious inspection process of the prior art. It is contemplated that only a representative sample of the components undergoing peening will have coverage confirmed. (For example, one out of every one hundred parts undergoing peening).

DETAILED DESCRIPTION

Figure 1:
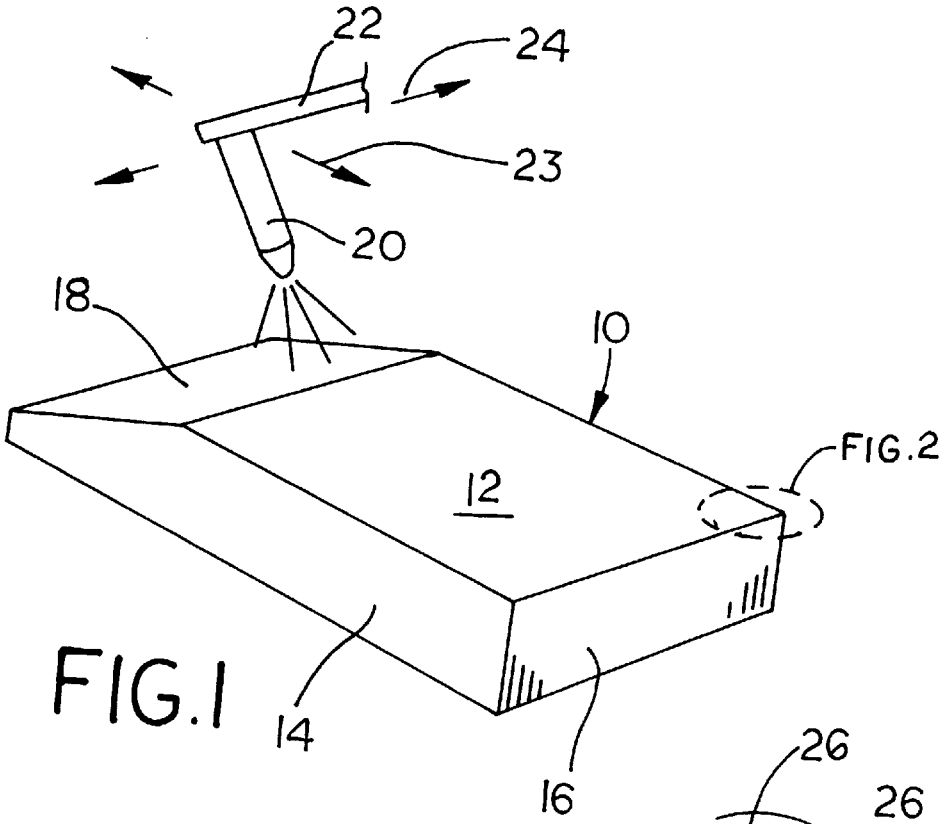
FIG. 1 is a view in perspective of a component undergoing peening, with the peening nozzle illustrated and carriage upon which the peening nozzle is mounted illustrated schematically.
Figure 2:
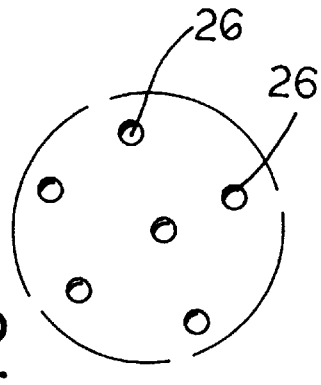
FIG. 2 is a highly enlarged view of the circumscribed portion of FIG. 1 illustrating the dimples in the surface of the component formed by the shot impacted against the surface.
Figure 3:
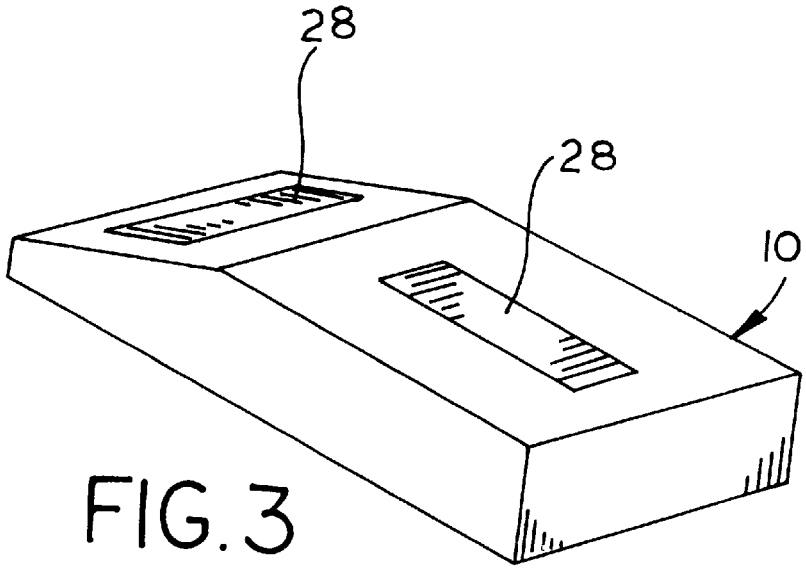
FIG. 3 is a view in perspective of the component illustrated in FIG. 1, with attached strips according to the present invention installed thereon.

Referring to FIG. 1, an article of arbitrary size and shape which is to undergo peening is illustrated at 10 The article includes a top surface 12, side surfaces 14 and 16, and perhaps includes angled surfaces, such as the surface 18, The intensity of the shot impacting the various surfaces will vary, since the intensity is also a function of the angle at which the shot impacts the surface. Ideally, the dimples created by the shot will completely cover the surface. Shot is accelerated through a peening gun generally indicated by the numeral 20, which is directed at the component 10 and is mounted on a carriage illustrated schematically at 22, which conveys the peening gun 20 at a predetermined stroke rate along the longitudinal axis 23 and transverse axis 24, such that all surfaces of the component 10 will be peened. Referring to FIG. 2, impact of the shot against the surface 12 results in spherical dents or depressions indicated by the numeral 26. One examines one or more of the surfaces 12–18 to determine coverage. This is usually done using a microscope. As discussed above, the separation between the dimples depression 26 indicate that coverage is not complete. Accordingly, the technician continues peening and then reading the dimples until coverage is complete. The cumulative peening time is then recorded, and the intensity of peening is maintained by using the aforementioned almen strip calibration process.

According to the invention, during production of components such as components 10, a calibration procedure of the peening equipment is run periodically, for example, after every one hundred components 10 have been peened. According to this procedure, the standard almen strip intensity measurement procedure as described above is performed After shot peening intensity has been confirmed, a test strip 28 or 31 according to the present invention is mounted on the surface 12 of the component 10. If the surface 18 is also a surface for which proper coverage may be assured, a second test strip 28 or 31 can be installed on this surface. The component 10 is then exposed to shot from the gun 20 under production conditions. After the component 10 has been peened under such conditions, the test strips are removed and examined to determine coverage, as will be hereinafter explained.

Figure 6:
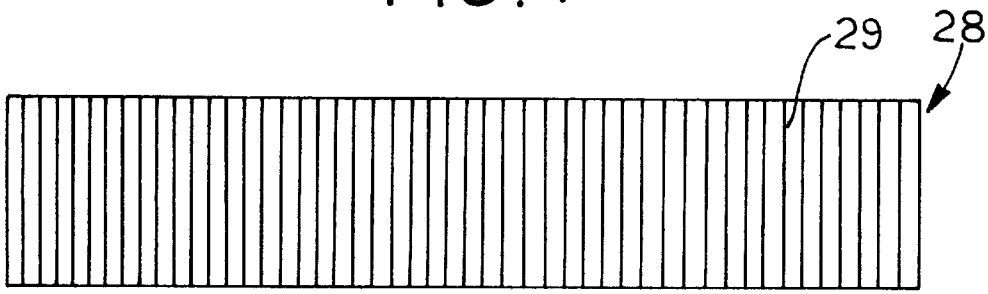
FIG. 6 is a view similar to FIG. 4, but illustrating a test strip of the present invention in which the surface irregularities are uniform across the strip; and, FIG. 7 is a view of a test strip similar to FIG. 4 but illustrating another embodiment of the invention.

Referring now to FIG. 6, test strip 28 is provided with surface irregularities, such as striations 29, which are distributed uniformly over the surface of the test strip. It is contemplated that the thickness of test strip 28 will be thicker than normal almen strips (for example on the order of 0.150 inch) such that the test strips 28 do not deflect during normal peening. It is also contemplated that a set of test strips 28 with varying hardnesses will be provided and that multiple test strips having striations of a depth different from other test strips of the same hardness will be available. The test strip that is used on the component 10 to confirm coverage will be determined in a manner hereinafter described. After the component 10 has been peened, test strips 28 are removed from the component.

The proper test strip 28 is selected from the aforementioned set of available test strips with different ranges of graduated striations and different hardness during the process development period. During the process development period, intensity of the shot peening process is controlled according to the almen strip procedure. A prototype of component 10 is then peened for a predetermined time period, and a developmental technician then examines one or more of the surfaces 12–18 to determine coverage. This is usually done using a microscope. As discussed above, the separation between the dimples depression 26 indicate that coverage is not complete. Accordingly, the technician continues peening and then reading the dimples until coverage is complete. The cumulative peening time is then recorded, and the intensity of peening is maintained by using the aforementioned almen strip calibration process.

After the technician is satisfied that the critical surfaces are completely covered, the technician selects one of the test strips 28 which is of a hardness and having a depth of the striations 29 that, in the technician's judgment, will be able to properly confirm coverage. The technician will install strip 28 on the surface 12. If surface 18 is also a critical surface for coverage, a second test strip will be installed on the surface. The prototype component 10 is then peened under production conditions for the prescribed time recorded in the earlier phase of developmental process. After completion, the strips are removed and examined. If the pattern of striations on the strip have been clearly reduced but still remain visible, the strip is archived for use as a standard.

The archived strip is then made available to the production operator, either as a physical component or as a paper copy of the physical component. The production operator mounts unpeened test strips 28 of the same hardness and striation depth as the test strip archived by the development technician to the appropriate surfaces of the production component and initiates peening. Periodically, the production operator discontinues peening and compares the test strips with the archived standard. When the test strips attached to the production component substantially match the standard, the operator knows that coverage is acceptable. Experienced production operators may read the strips directly without direct comparison to the archived standard.

Figure 4:
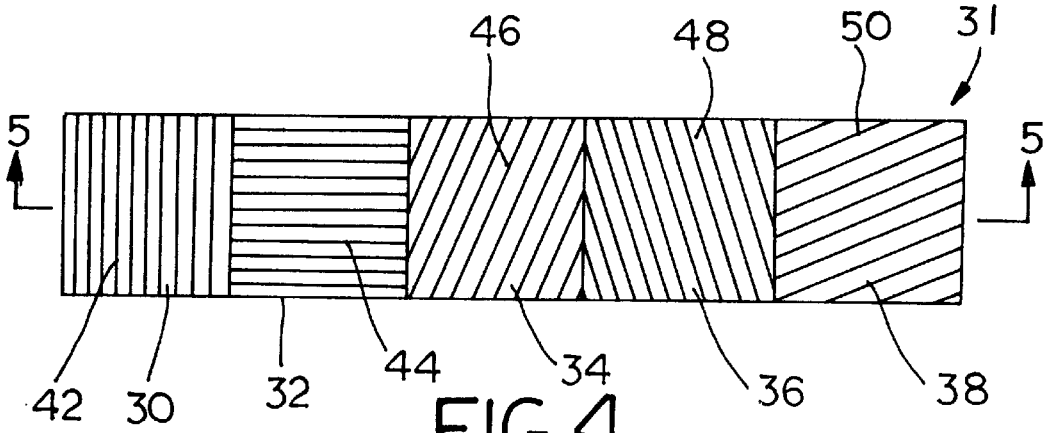
FIG. 4 is an enlarged view of a test strip made pursuant to the teachings of the present invention having separate sections of surface irregularities of graduating depth.
Figure 5:
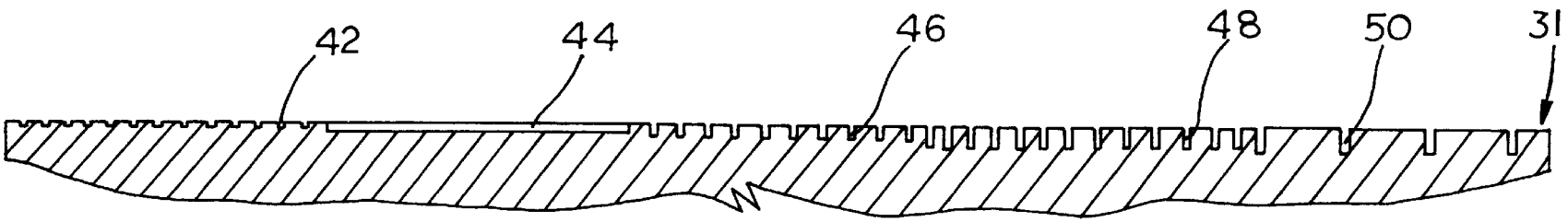
FIG. 5 is an enlarged cross-sectional view taken substantially along lines 5—5 of FIG. 4.

Referring to the alternate embodiment of FIG. 4, test strip 31 is divided into regions, 30, 32, 34, 36, and 38, each of which is provided with surface irregularities, such as the striations. It will be noted that region 30 is provided with striations 42 extending transverse to strip 28, section 32 is provided with striations 44 extending longitudinally, and sections 34, 36 and 38 ale provided with striations 46,48, and 50, which extend at angles with respect to the strip. As can be seen in FIG. 5, the depth of the striations 42 is minimal, whereas the depth of the striations 50 is maximum, with the depth of the striations 44, 46 and 48 gradate between the minimum depth striations and maximum depth striations The test strips 31 will be available in a range of hardness and with a varying range of depths of surface irregularities of the regions 30–36.

During prototype development, after assuring that the critical surfaces are completely covered by the microscopic inspection process described above, the development technician selects one of the test strips 31 that, in the technician's judgment, will be able to properly confirm peening coverage. If the strips indicate that the regions 30, 32, 34 where the depth of the striations is lesser, are obliterated, and the regions 36, and 38, where the depth is greater, remain visible, the selection of the test strip 31 is confirmed. It will also be acceptable that only one of the regions 38 having striations of greatest depth remain visible to have a proper coverage confirmation. If all of the regions or obliterated, or if striations remain visible on all of the regions, another strip 34 is selected from the set having a greater or lesser hardness, or greater or lesser range of striation depth. This newly selected test strip is then installed on the component and peened under the aforementioned production conditions.

The production operator mounts test strips 31 identical to those selected during the prototype development on the appropriate surface and begins peening. After completion of peening, the production operator wads the strips 31 to ascertain if the corresponding regions of the test strip remain visible while the other regions have been obliterated If all of the regions remain visible, the production operator knows that complete coverage has not been obtained. If all regions have been obliterated, the production operator knows that over peening has occurred. In either case, the operator then knows that the machinery must be examined and corrected. The test strip may also be physically compared to the test strip peened during prototype development and archived as a standard for comparison as discussed above.

In case of critical parts, such as for the aircraft industry, test strips 28 and 31 may be archived to later prove that the component parts have been properly peened and that peening has occurred with the proper intensity (as confirmed by the aforementioned almen strip process), and with the proper coverage, as confirmed by the test strip 28 or 31.

Figure 7:
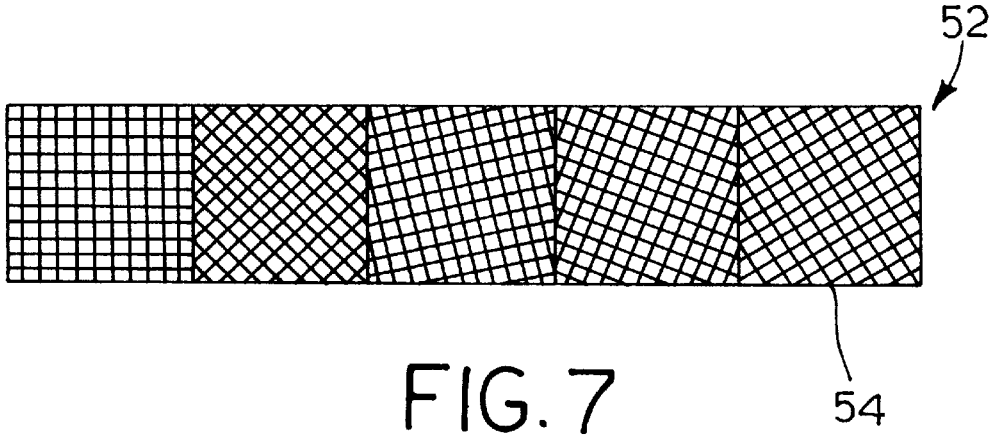

Referring to FIG. 7, crisscrossing surface irregularities 57 are shown on test strip 52.

What is claimed is:

1. Test strip for establishing shot peening coverage, said strip having opposite surfaces, one of said surfaces being a substantially flat surface and the opposite surface being a textured surface defining irregularities of a predetermined depth, said strip having a thickness sufficient that said strip does not deflect during normal shot peening.

2. Test strip as claimed in claim 1, wherein said irregularities on said textured surface are distributed in a uniform pattern across the textured surface.

3. Test strip as claimed in claim 2, wherein said irregularities are of a substantially constant depth.

4. Test strip as claimed in claim 3, wherein said irregularities are defined by striations.

5. Test strip as claimed in claim 1, wherein said textured surface includes multiple sections of irregularities, the depth of the irregularities of each section being unequal to the depth of the irregularities of an adjoining section.

6. Test strip as claimed in claim 5, wherein said irregularities are defined by striations, the striations in adjoining sections being oriented to extend in a direction different from the orientation of the striations in an adjoining section.

7. Test strip as claimed in claim 1, wherein said irregularities are defined by striations.

8. Test strip for establishing shot peening coverage, said strip having opposite surfaces, one of said surfaces being a substantially flat surface and the opposite surface being multiple sections of textured surface, each section of textured surface defining irregularities of a predetermined depth, the depth of the irregularities of each of said multiple sections being unequal to the depth of the irregularities of an adjoining section.

9. Test strip as claimed in claim 8, wherein said irregularities are defined by striations, the striations in adjoining sections being oriented to extend in a direction different from the orientation of the striations in an adjoining section.

10. Method of confirming that a component undergoing shot peening has attained a predetermined peening coverage comprising the steps of mounting a testing test strip having a test surface having surface irregularities in a predetermined pattern on a component the peening coverage of which is to be confirmed, said surface irregularities being modified when the predetermined peening coverage is attained, peening the component at a predetermined intensity, and examining the testing test strip to confirm peening coverage, said test strip including multiple sections of surface irregularities, the irregularities of each section having a pattern distinct from the irregularities in an adjacent section.

11. Method of confirming that a component undergoing shot peening has attained a predetermined peening coverage comprising the steps of mounting a testing test strip having a test surface having surface irregularities in a predetermined pattern on a component the peening coverage of which is to be confirmed, said surface irregularities being modified when the predetermined peening coverage is attained, peening the component at a predetermined intensity, and examining the testing test strip to confirm peening coverage, said test strip including multiple sections of surface irregularities, said step of examining said test strip including the step of noting that predetermined sections of said test strip have been obliterated to indicate satisfactory peening coverage.

* * * * *